US010422070B2

(12) United States Patent
Bixby et al.

(10) Patent No.: US 10,422,070 B2
(45) **Date of Patent: *Sep. 24, 2019**

(54) LAUNDRY TREATING APPLIANCE AND DISPENSER

(71) Applicant: WHIRLPOOL CORPORATION, Benton Harbor, MI (US)

(72) Inventors: Seth E. Bixby, Stevensville, MI (US); Richard K. Gresens, Saint Joseph, MI (US); Todd Lambkin, Stevensville, MI (US); Michael R. MacKay, Buchanan, MI (US); Sayer J. Murphy, Saint Joseph, MI (US); Anna C. Schelling, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/021,114

(22) Filed: Jun. 28, 2018

(65) Prior Publication Data

US 2018/0313019 A1 Nov. 1, 2018

Related U.S. Application Data

(63) Continuation of application No. 15/263,726, filed on Sep. 13, 2016, now Pat. No. 10,077,526.

(51) Int. Cl.
*D06F 39/02* (2006.01)
*D06F 37/20* (2006.01)
(Continued)

(52) U.S. Cl.
CPC ..... *D06F 39/02* (2013.01); *D06F 37/203* (2013.01); *D06F 37/28* (2013.01); *D06F 39/12* (2013.01)

(58) Field of Classification Search
CPC ..... D06F 39/02; D06F 39/022; D06F 39/028; D06F 39/088; D06F 33/02
(Continued)

(56) References Cited

U.S. PATENT DOCUMENTS 3,584,763 A * 6/1971 Donselman ..... A47L 15/4409 222/54
3,811,600 A * 5/1974 Allison ..... A47L 15/4409 222/166
(Continued)

FOREIGN PATENT DOCUMENTS

DE 102008029364 A1 12/2009
EP 1842953 A2 10/2007
(Continued)

OTHER PUBLICATIONS

Database WPI Week 200903 Thomson Scientific, London, GB; AN 2009-A65448 XP002774245, -& KR 100 843 440 B1 (Samsung Electro-Mechanics Co) Jul. 3, 2008 (Jul. 3, 2008).
(Continued)

*Primary Examiner* — Michael E Barr
*Assistant Examiner* — Thomas Bucci
(74) *Attorney, Agent, or Firm* — McGarry Bair PC

(57) ABSTRACT

A laundry treating appliance having a housing defining an interior that terminates in an upper edge that defines a door profile. A treating chamber is located within the interior and is mounted to the housing. A dispenser door is pivotally mounted to the housing for pivoting movement between closed and opened positions. At least one dispenser cup is fluidly coupled to the treating chamber and is slidably mounted to the housing for sliding movement between extended and retracted positions. The at least one dispenser cup is operably coupled to the dispenser door such that pivotal movement of the dispenser door between the closed
(Continued)

and opened positions effects a corresponding sliding movement of the at least one dispenser cup between the retracted and extended positions while maintaining the dispenser cup in an upright position. The at least one dispenser cup has a portion that is complementary in shape to the door profile and nests within the door profile when the dispenser door is in the opened position and the at least one dispenser cup is in the extended position.

20 Claims, 12 Drawing Sheets

(51) Int. Cl.
*D06F 37/28* (2006.01)
*D06F 39/12* (2006.01)

(58) Field of Classification Search
USPC ..... 68/17 R, 207, 12.18, 3 R, 13 R, 17 A, 68/212, 13 A, 12.19; 222/651, 129, 173, 222/1, 652, 166, 52, 16 D, 181.2, 325, 222/456, 164; 134/93, 56 D, 99.2, 18
See application file for complete search history.

(56) References Cited

U.S. PATENT DOCUMENTS 4,009,598 A * 3/1977 Bernard ..... D06F 39/02 134/103.1
4,265,100 A * 5/1981 Kretchman ..... D06F 39/022 134/100.1
4,323,170 A * 4/1982 Ikeda ..... D06F 39/026 134/93
5,675,994 A * 10/1997 Gweon ..... D06F 39/02 68/17 R
5,836,180 A * 11/1998 Herman-Latack ..... D06F 39/02 68/17 R
5,875,655 A * 3/1999 Herman-Latack .... D06F 39/026 222/166
7,219,517 B2 5/2007 Maeng
8,839,648 B2 * 9/2014 Je ..... D06F 39/02 68/17 R
8,893,531 B2 * 11/2014 Mun, II ..... D06F 39/02 68/12.18
8,931,667 B2 * 1/2015 Smith ..... D06F 39/022 222/325
10,077,526 B2 * 9/2018 Bixby ..... D06F 37/203
2003/0106570 A1 * 6/2003 Cerruti ..... A47L 15/4409 134/18
2003/0188768 A1 * 10/2003 Cerruti ..... A47L 15/4409 134/57 D
2004/0069325 A1 * 4/2004 Cerruti ..... A47L 15/4409 134/25.2
2004/0103696 A1 * 6/2004 Kim ..... D06F 39/02 68/17 R
2006/0144424 A1 * 7/2006 Marchitto ..... A47L 15/4409 134/25.2
2006/0162392 A1 * 7/2006 Kwon ..... D06F 39/02 68/17 R
2006/0261717 A1 * 11/2006 Chirumbolo ..... B60N 3/083 312/333
2008/0072632 A1 * 3/2008 Je ..... D06F 39/02 68/17 R
2008/0078211 A1 * 4/2008 Je ..... D06F 39/02 68/17 R
2008/0295546 A1 * 12/2008 Cho ..... D06F 39/02 68/17 R
2009/0308111 A1 * 12/2009 Robb ..... D06F 37/10 68/17 R
2011/0174021 A1 * 7/2011 Lee ..... D06F 29/00 68/17 R
2014/0075684 A1 * 3/2014 Kim ..... D06F 39/02 8/137
2014/0137608 A1 * 5/2014 Seikel ..... D06F 39/02 68/17 R
2014/0159559 A1 * 6/2014 Kim ..... D06F 39/12 312/319.1
2015/0252513 A1 * 9/2015 Seo ..... D06F 39/028 68/17 R
2015/0252514 A1 * 9/2015 Seo ..... D06F 39/028 68/17 R
2016/0017532 A1 1/2016 Jo et al.

FOREIGN PATENT DOCUMENTS

IT TO20060258 A1 10/2007
KR 19980027466 U 8/1998
WO 2013032224 A2 3/2013

OTHER PUBLICATIONS

European Search Report for Counterpart EP17183823.8, dated Oct. 13, 2017.

* cited by examiner

LAUNDRY TREATING APPLIANCE AND DISPENSER

CROSS-REFERENCE TO RELATED APPLICATIONS

This application is a continuation of U.S. patent application Ser. No. 15/263,726 filed Sep. 13, 2016, now U.S. Pat. No. 10,077,526, issued on Sep. 18, 2018, which is herein incorporated by reference in its entirety.

BACKGROUND

Laundry treating appliances, such as clothes washers, clothes dryers, refreshers, and non-aqueous systems, can have a configuration based on a rotating drum that defines a treating chamber having an access opening through which laundry items are placed in the treating chamber for treating. The laundry treating appliance can have a controller that implements a number of pre-programmed cycles of operation having one or more operating parameters.

In some laundry treating appliances, the dispenser is in the form of a drawer that slides in/out of the appliance. Such dispensers typically have one or more reservoirs or cups in which single doses of treating chemistry can be received when the drawer is open. The aesthetic appearance and experience of operating the dispenser drawer can be an important factor that contributes to the overall user satisfaction.

BRIEF SUMMARY

In one aspect, the disclosure relates to a laundry treating appliance having a housing defining an interior that terminates in an upper edge that defines a door profile. A treating chamber is located within the interior and is mounted to the housing. A dispenser door is pivotally mounted to the housing for pivoting movement between closed and opened positions. At least one dispenser cup is fluidly coupled to the treating chamber and is slidably mounted to the housing for sliding movement between extended and retracted positions. The at least one dispenser cup is operably coupled to the dispenser door such that pivotal movement of the dispenser door between the closed and opened positions effects a corresponding sliding movement of the at least one dispenser cup between the retracted and extended positions while maintaining the dispenser cup in an upright position. The at least one dispenser cup has a portion that is complementary in shape to the door profile and nests within the door profile when the dispenser door is in the opened position and the at least one dispenser cup is in the extended position.

In another aspect, the disclosure relates to a dispenser assembly for a for a laundry treating appliance. The dispenser assembly has a frame that terminates in an upper edge that defines a door profile. A dispenser door is pivotally mounted to the frame for pivoting movement between closed and opened positions. At least one dispenser cup is slidably mounted to the frame for sliding movement between extended and retracted positions. The at least one dispenser cup is operably coupled to the dispenser door such that pivotal movement of the dispenser door between the closed and opened positions effects a corresponding sliding movement of the at least one dispenser cup between the retracted and extended positions while maintaining the dispenser cup in an upright position. The at least one dispenser cup has a portion that is complementary in shape to the door profile and nests within the door profile when the dispenser door is in the opened position and the at least one dispenser cup is in the extended position

DETAILED DESCRIPTION

Figure 1:
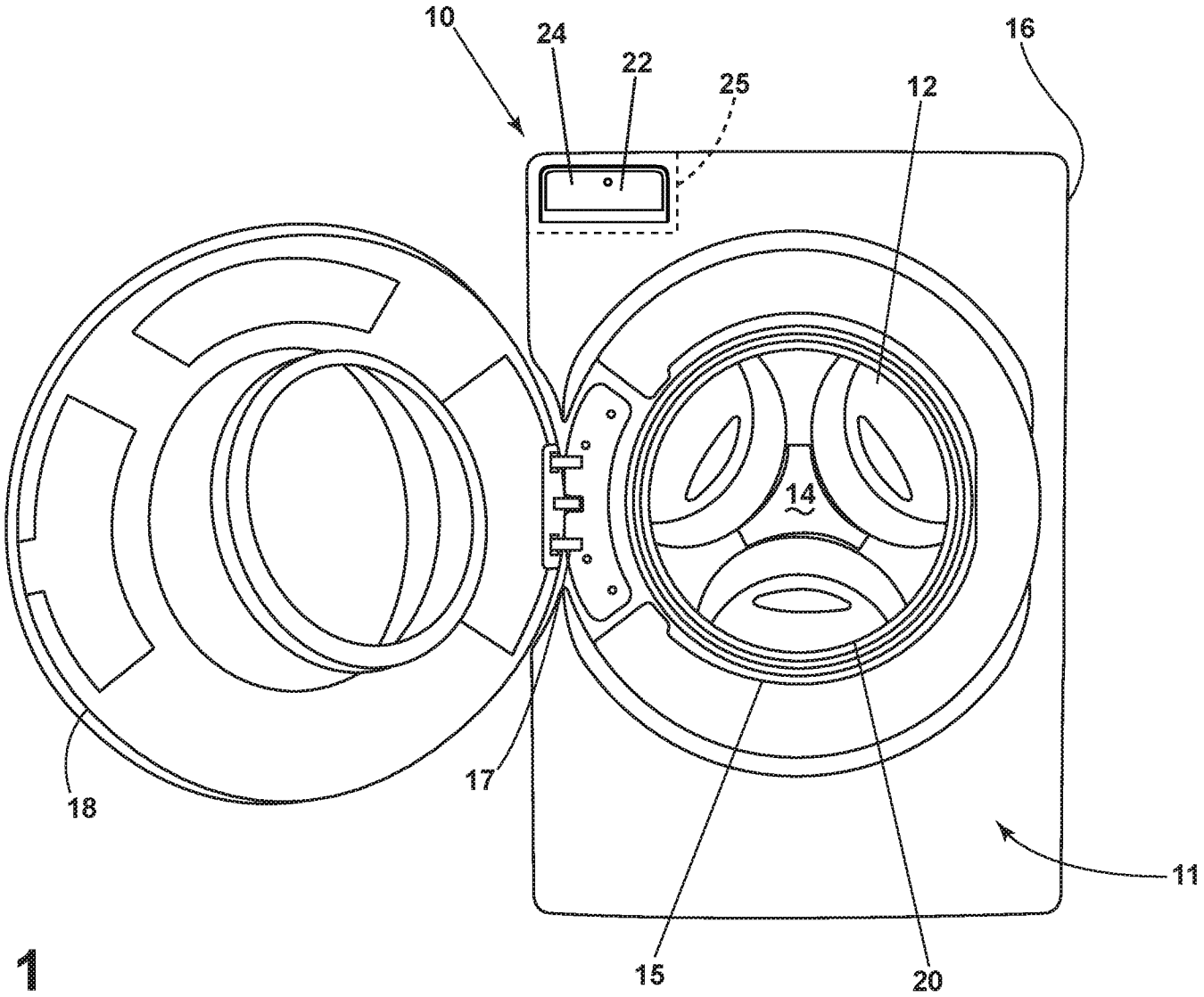
FIG. 1 is a front view of a laundry treating appliance in the form of an automatic washing machine having a housing with a door shown in an opened condition, and with a push-to-open dispenser.

FIG. 1 illustrates a laundry treating appliance in the environment of a horizontal axis automatic clothes washing machine 10. Although much of the remainder of this application will focus on the illustrative embodiment of an automatic clothes washing machine, aspects of the disclosure have utility in other environments, including other laundry treating appliances or other front loading appliances with a dispenser drawer element. Depending on the configuration, it is possible for aspects of the disclosure to have applicability in vertical axis washing machines and other top loading appliance.

The washing machine 10 has a rotatable drum 12 that defines a treating chamber 14 for receiving the laundry and rotates about a generally horizontal axis. A tub 15 receives the drum 12 and holds liquid for use in a treating cycle of operation. The tub 15 can rotatably mount the drum 12. The tub 15 can be associated with a sump for holding a liquid used during a cleaning cycle. The sump can be normally connected to a drain (not shown) to provide a flow path for removing the liquids.

A housing 16 can define a cabinet within which a suspension system (not shown) is provided for suspending the tub 15 within the housing 16. The housing 16 can have a chassis and/or a frame to which panels are mounted to define an interior 11, enclosing components typically found in a conventional washing machine, such as motors, pumps, fluid lines, controls, sensors, transducers, and the like. Such components will not be described further herein except as necessary for a complete understanding of the disclosure.

A closure in the form of a cabinet door 18 is mounted to the housing 16 via a hinge 17. The door 18 can be rotated about the hinge 17 to selectively close an opening 20 to the treating chamber 14. Both the tub 15 and a drum 12 can be located within the interior 11 of the housing 16.

The washing machine 10 can also be provided with a dispenser 22 for dispensing treating chemistry to the treating chamber 14 for use in treating the laundry according to a cycle of operation. The dispenser 22 has a dispenser frame 25 that can be an integrated part of the housing 16 or can be a separate component mounted to the housing 16. The dispenser 22 is illustrated as a single use dispensing assembly. However, a bulk dispenser can be provided integrated with or separate from the single use dispenser 22.

Non-limiting examples of treating chemistries that can be dispensed by the dispenser 22 during a cycle of operation include one or more of the following: water, detergents, softeners, bleach, rinse aids, surfactants, enzymes, fragrances, stiffness/sizing agents, wrinkle releasers/reducers, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

Figure 2:
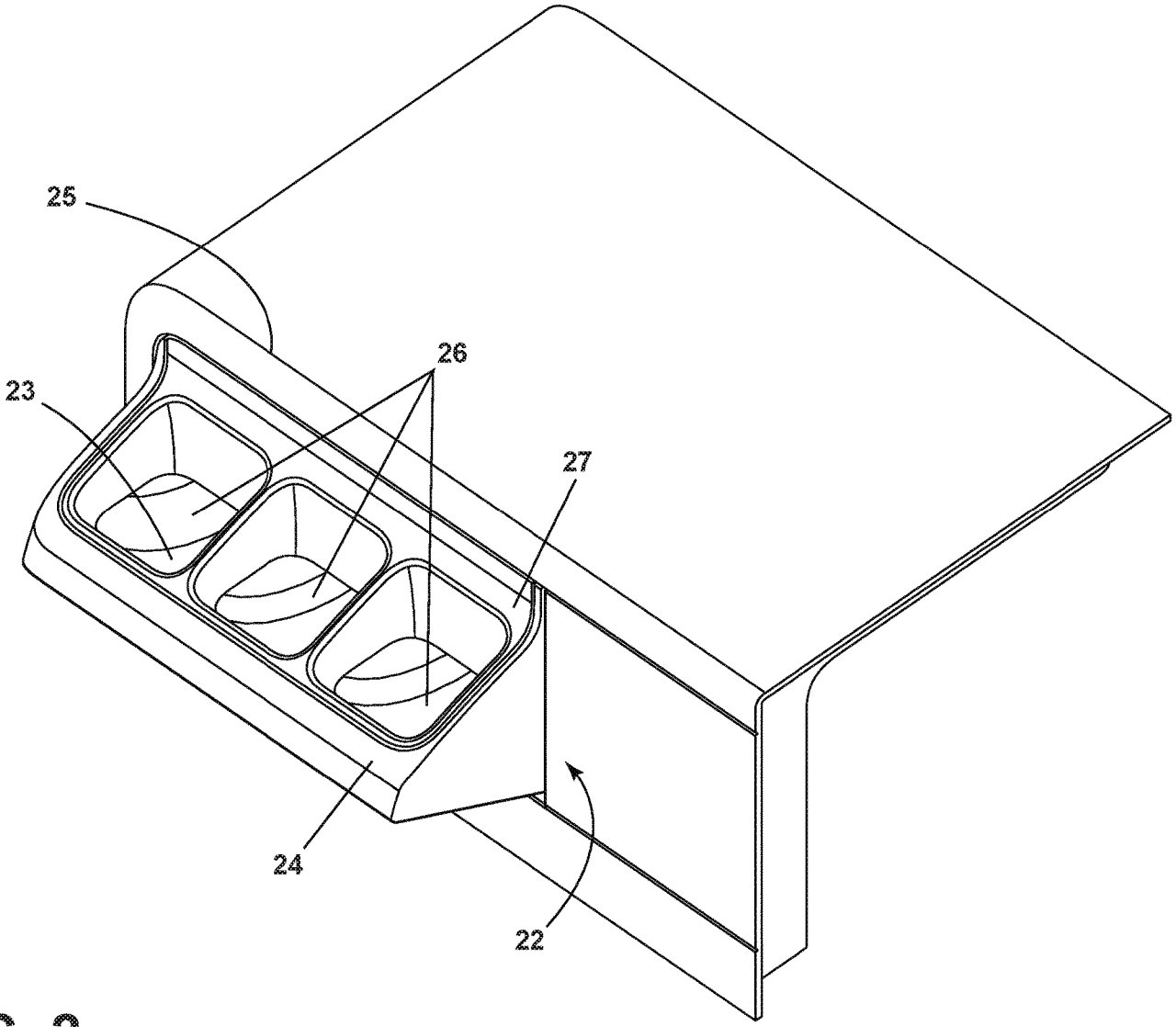
FIG. 2 is a perspective view of a dispenser of the laundry treating appliance of FIG. 1 in an opened position.

Referring to FIG. 2, the dispenser 22 includes a dispenser door 24 carrying at least one dispenser container 23. The dispenser container 23 can be implemented as a drawer 27 having multiple cups 26 fluidly isolated from each other so that various kinds of treating chemistries can be provided in the different cups 26 without inter-mixing.

The dispenser door 24 can be pivotally mounted to the dispenser frame 25 for pivoting movement between a closed position overlying the opening of the dispenser frame 25 and an opened position wherein the at least one dispenser container 23 can be accessible exteriorly of the housing 16 and can be filled or refilled with treating chemistry. The dispenser drawer is fluidly coupled to the treating chamber 14 and slidably mounted to the dispenser frame 25 for sliding movement between extended and retracted positions relative to the frame 25. The dispenser drawer 27 is also pivotally mounted to the dispenser door 24 such that pivotal movement of the dispenser door 24 between the closed and opened position effects a corresponding sliding movement of the at least one dispenser container 23 between the retracted and extended position, respectively.

As shown in the illustration, when the dispenser door 24 is in an opened position with the dispenser drawer 27 fully extended wherein the dispenser drawer 27 terminates in an upper edge that defines a door profile and the drawer 27 has a portion that is complementary in shape to the door profile and nests within the door profile. Thus, when the door 24 is in the opened position, the door 24 and drawer 27 appear as a unitary structure.

Figure 3:
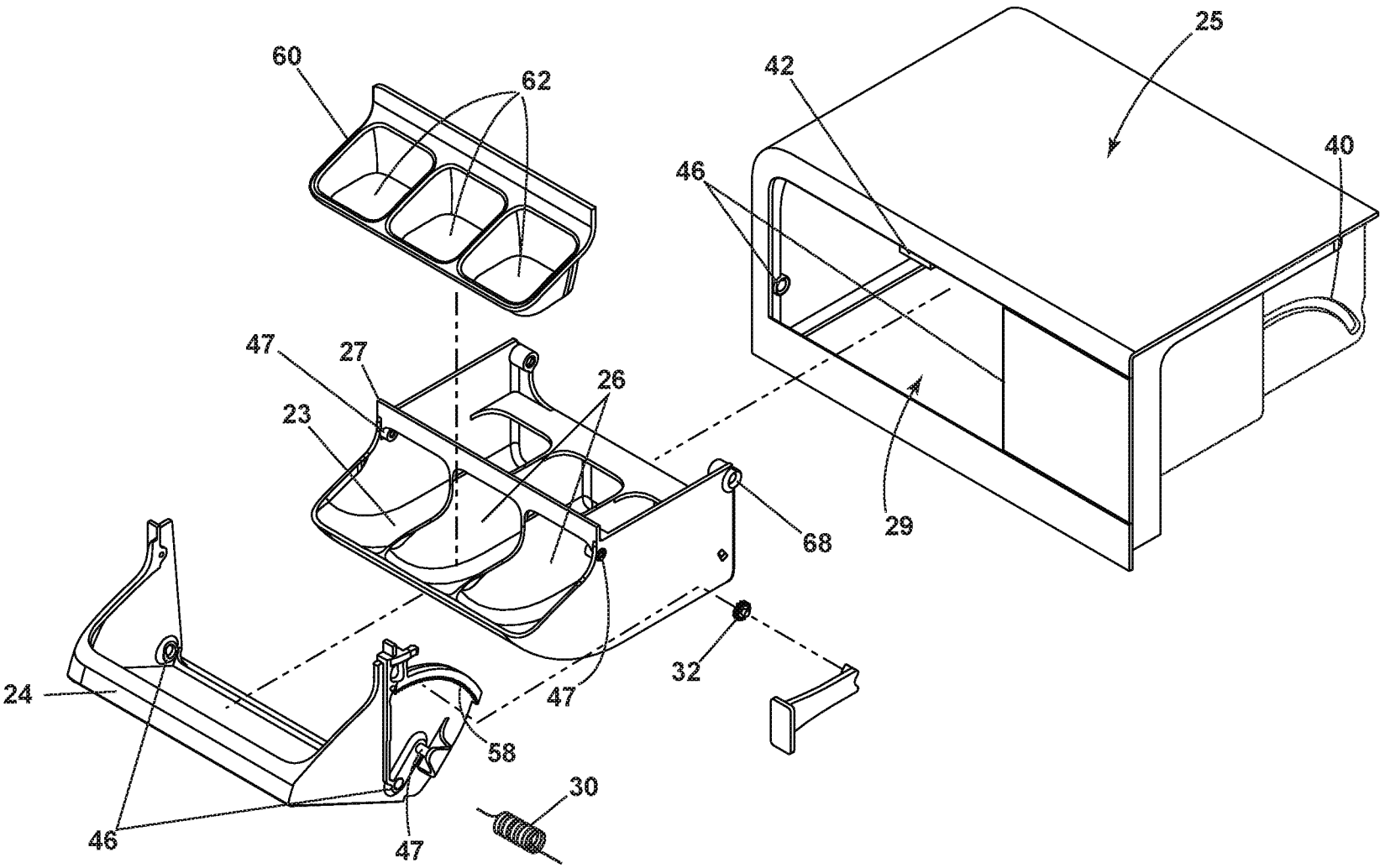
FIG. 3 is an exploded, perspective view of the dispenser of FIG. 2.

Referring to FIG. 3, the structural details of the dispenser 22 will be described. The dispenser 22 includes a dispenser frame 25, which can be located within the housing or formed as part of the housing of the appliance 10. The dispenser door 24 door is pivotally mounted to the dispenser frame 25, but could be pivotally mounted to the housing as an alternative. The drawer 27 is slidably mounted to the dispenser frame 25 and has integrally formed cups 26. A fill bezel or trim insert 60 is mounted to the drawer 27 and defines fill openings 62 for each of the cups 26. The trim insert 60 can be removably mounted to the drawer 27. A biasing device 30 can be provided to bias the dispenser door 24 from the closed to the opened position. A damper 28 controls the rate at which the door moves from the closed to the opened positions in response to the biasing force of the biasing device 30 to provide a soft opening.

A slot 40 and pin 68 structure can be used to slidably mount the drawer 27 to the dispenser frame 25. The slot 40 can be located within the dispenser frame 25 and the pin 68 can extend from the drawer 27 and into the slot 40. The slot 40 can have any shape, but is shown as curvilinear, which results in the drawer 27 raising/lowering as it is moved from the closed/opened positions, respectively. Thus, with this configuration, the vertical position of the drawer 27 changes along with its sliding position. However, the height of the drawer 27 need not change to implement aspects of the disclosure. Also, the locations of the track 40 and pin 68 can be reversed. Further, only one slot 40 and gear mounting portion 44 is shown on one side of the frame 25, there can be a slot 40 and a gear mounting portion 44 on both sides of the dispenser frame 25.

The door 24 can be pivotally mounted to the dispenser frame 25 by a pivot link comprising a link that is pivotally connected at each end to door pivots 46, one located on the dispenser frame 25 and the other located on the door 24. The drawer 27 can be pivotally mounted to the door 24 by a pivot link pivotally connected at each end to drawer pivots 47. The pivot links provide for a pivoting as well as a raising of the drawer 27 as the door 24 moves from the closed to opened positions, in a motion similar to that provided by the slot/pin structure of the drawer 27. In this way, the door 24 and drawer 27 both raise as the door 24 is opened and fill the gap in a frame opening 29 that would normally be left by a traditional pivoting of the door 24 and sliding of the drawer 27. The vertical raising of the door 24 and drawer 27 provides for the door 24 and drawer 27 to fill a gap with the frame 25 and/or housing 16, which would otherwise exist, which provides a unique and high quality finish to the dispenser.

The damper 28 is illustrated as a gear track 58 and a complementary gear 32 which meshes with the gear track 58. The gear track 58 is located on the door 24 and the gear 32 is rotatably mounted to the dispenser frame 25. The complementary gear 32 can include or be connected to frictional elements or dampening fluids for providing a dampening action. The locations of the gear track 58 and gear 32 could be reversed. Other damper structures are contemplated. The frictional resistance between the meshed teeth of the gear 32 and gear track 58 provide the damping function.

Figure 4A:
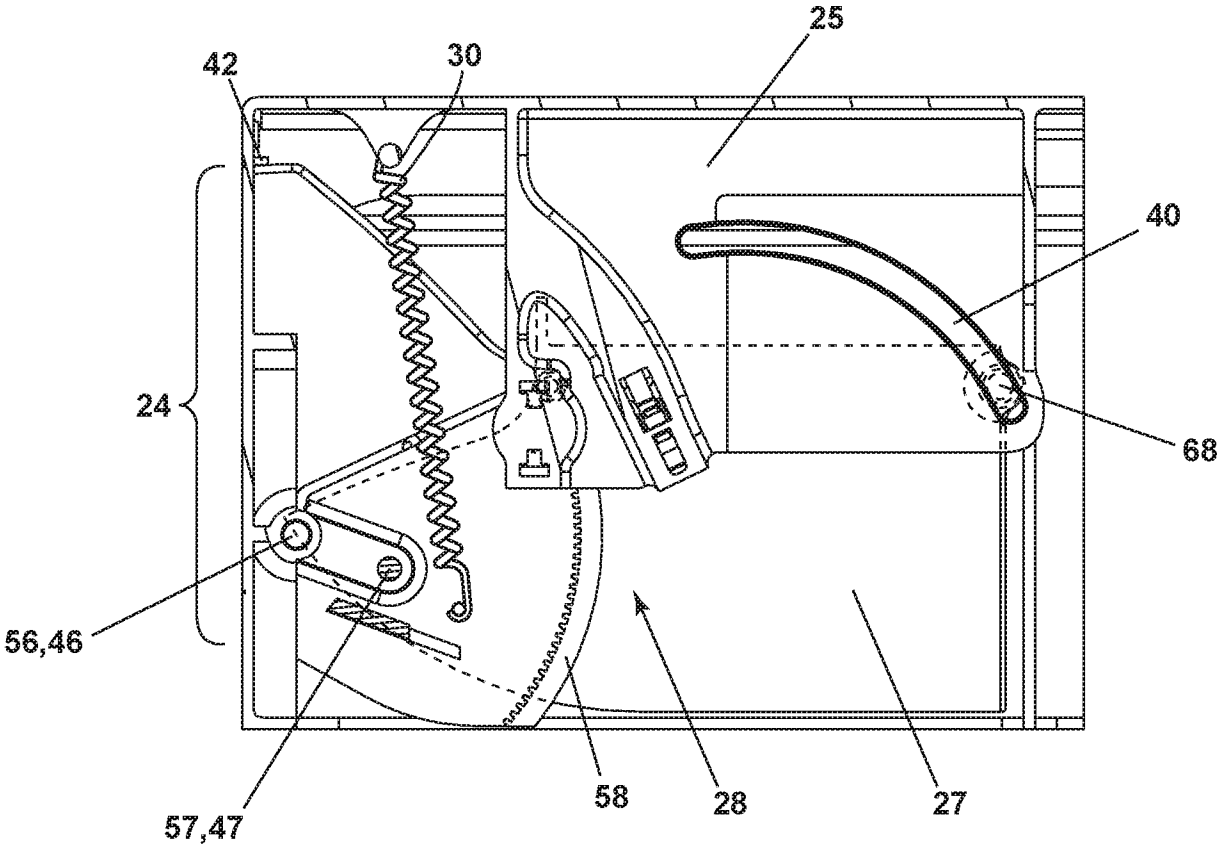
FIG. 4A is a side view of the dispenser in a closed position.

FIG. 4A shows the dispenser with exposed mechanical components in a closed position. Biasing device 30 can be a spring extending between the door 24 and frame 25. In the closed position, the biasing device 30 is fully extended and tensioned where a push-to-open latch 42 secures the dispenser door 24 in the closed position. The pin 68 that extends from the drawer 27 and into the curvilinear slot 40 of the frame 25 slides to the lower right position lowering the drawer 27 position.

Pivot link 56 can comprises a link 56 that is pivotally connected at each end to door pivots 46. Pivot link 57 can pivotally connect at each end to drawer pivots 47. The pivot links 56 and 57 provide for a pivoting as well as a raising of the drawer 27 as the door 24 moves from the closed to opened positions.

Figure 4B:
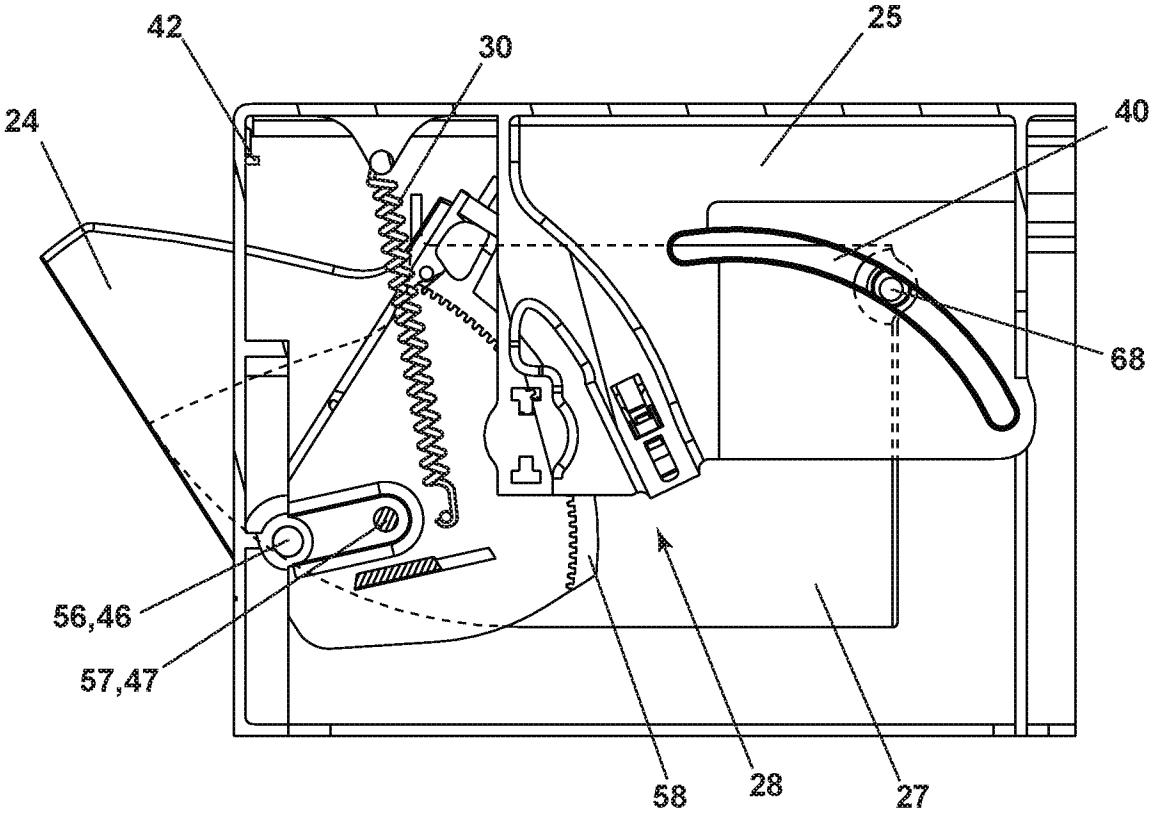
FIG. 4B is a side view of the dispenser in a partially opened position.

As shown in FIG. 4B, the dispenser is in a partially opened position. When the door is pushed in to trigger the release of the pushed to open latch 42, the biasing device 30 biases the door 24 towards the opened position. The damper 28 dampened the movement of the door 24 to produce a smooth motion. The pin 68 that extends from the drawer 27 and into the curvilinear slot 40 of the frame 25 slides towards the left position and slowly raising the drawer 27 position.

Figure 4C:
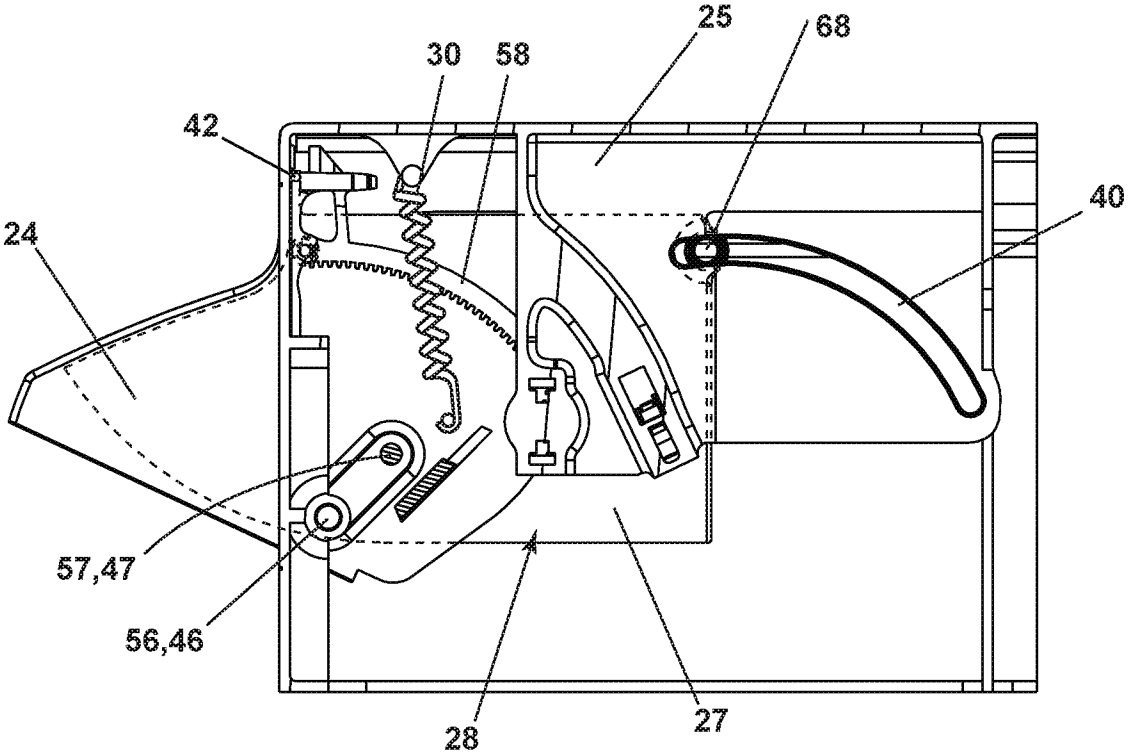
FIG. 4C is a side view of the dispenser in an opened position.

Referring to FIG. 4C, when the door 24 is moved to the opened position, the vertical position of the drawer 27 changes along with its sliding position. This allows for the dispenser drawer 27 to present itself upward and outward in a single continuous motion. The combination of pivoting and sliding movement of the drawer 27 relative to the dispenser door 24 and dispenser frame 25 is configured to maintain the drawer 27 at an upright position throughout the opening and closing motion to minimize sloshing of treating chemistry.

The single continuous motion of the dispenser drawer 27 in presenting itself upward and outward creates a pleasant experience to the user. Furthermore, the matching profile between the upper edge of the drawer 27 and the door 24 in the opened position provides a clean finish and aesthetically pleasing appearance, which is viewed by consumers as very high quality.

Figure 5:
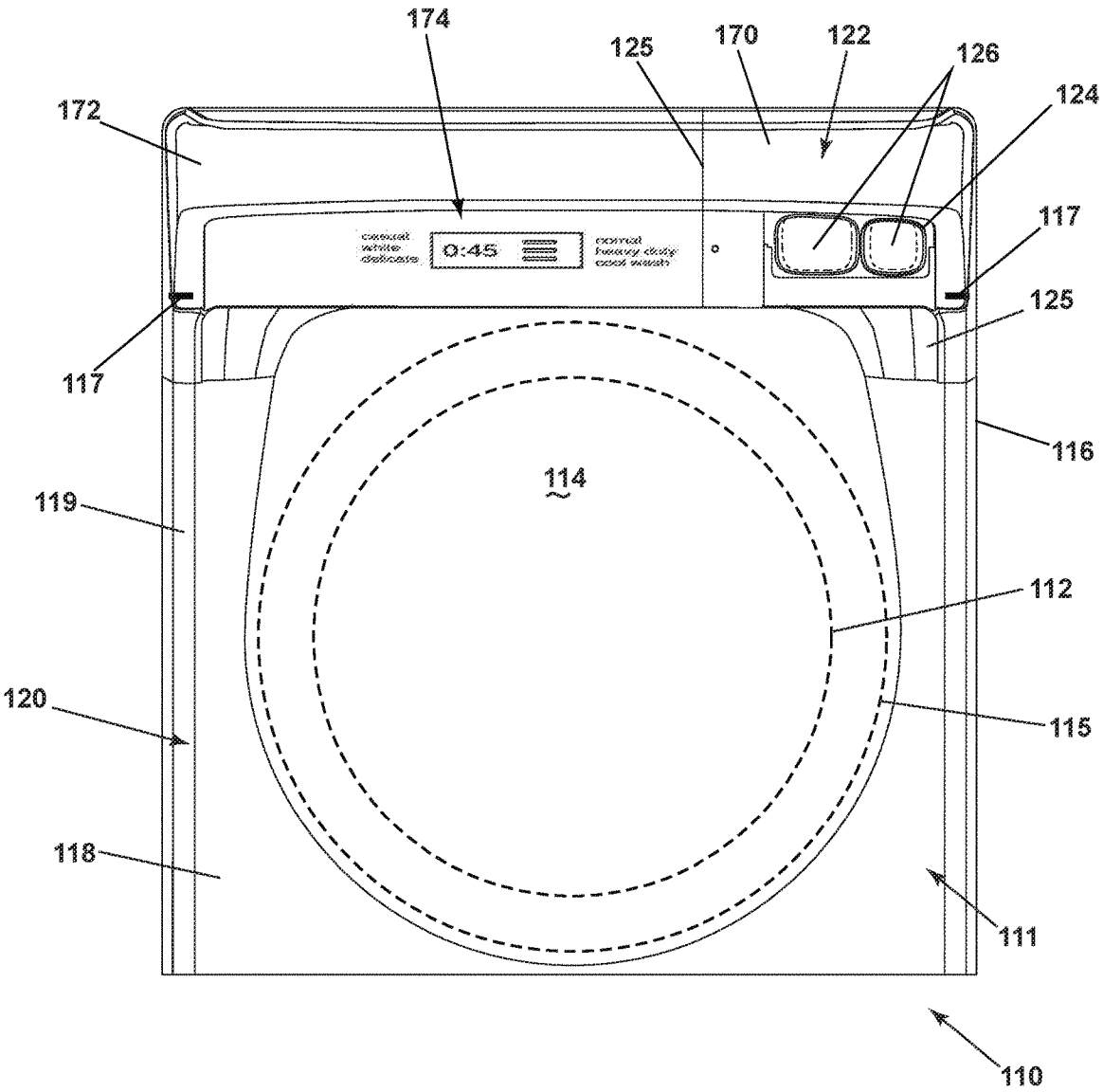
FIG. 5 is a top perspective view of a laundry treating appliance in the form of an automatic washing machine having a housing and a dispenser.

FIG. 5 illustrates another aspect of the present disclosure is illustrated as a laundry treating appliance in the environment of a vertical axis automatic clothes washing machine 110. The washing machine 110 is similar to the washing machine 10 previously described and therefore, like parts will be identified with like numerals increased by 100, with it being understood that the description of the like parts of the washing machine 10 applies to the parts of the washing machine 110, unless otherwise noted. The aspects of the disclosure have utility in other environments, including other laundry treating appliances or other top loading appliances with a dispenser drawer element. Depending on the configuration, it is possible for the aspects of the disclosure to have applicability in horizontal axis washing machines and other appliances.

The washing machine 110 has a rotatable drum 112 that defines a treating chamber 114 for receiving the laundry and rotates about a generally vertical axis. A tub 115 receives the drum 112 and holds liquid for use in a treating cycle of operation. The tub 115 can rotatably mount the drum 112. The tub 115 can be associated with a sump for holding a liquid used during a cleaning cycle. The sump (not shown) can be normally connected to a drain (not shown) to provide a flow path for removing the liquids.

A housing 116 can define a cabinet within which a suspension system (not shown) is provided for suspending the tub 115 within the housing 116. The housing 116 can have a chassis to which panels are mounted to define an interior 111, enclosing components typically found in a conventional washing machine, such as motors, pumps, fluid lines, controls, sensors, transducers, and the like. Such components will not be described further herein except as necessary for a complete understanding of the disclosure. Both the tub 115 and a drum 112 can be located within the interior 111 of the housing 116.

A closure in the form of a lid or door 118 can be mounted to the housing 116 via hinges 117. The door 118 can be rotated about the hinges 117 to selectively close an opening 120 to the treating chamber 114. The housing 116 can have an upper surface 119 with a console 172 extending up from the upper surface 119. The console 172 can be a dashboard housing a user interface 174 facing upwards and forward toward a user.

The washing machine 110 can also be provided with a dispenser 122 for dispensing treating chemistry to the treating chamber 114 for use in treating the laundry according to a cycle of operation. The dispenser 122 can have a dispenser frame 125 that is an integrated part of the housing 116. Alternatively, the frame 125 can be a separate component mounted to the housing 116 and covered with a shroud 170. The dispenser 122 is illustrated as a single use dispensing assembly. However, a bulk dispenser can be provided either integrated with or separate from the single use dispenser 122.

The dispenser 122 is illustrated as having two dispenser containers 126, which are fluidly coupled to the treating chamber 114. The dispenser containers 126 can be slidably mounted to the housing 116 or frame 125 for sliding movement between extended (FIG. 6) and retracted positions (FIG. 5). In FIG. 5, the dispenser 122 is shown with dispenser containers 126 in the retracted position and a door 124 has been illustrated as closing an access opening in the shroud 170 or console 172.

Non-limiting examples of treating chemistries that can be dispensed by the dispenser 122 during a cycle of operation include one or more of the following: water, detergents, softeners, bleach, rinse aids, surfactants, enzymes, fragrances, stiffness/sizing agents, wrinkle releasers/reducers, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

Figure 6:
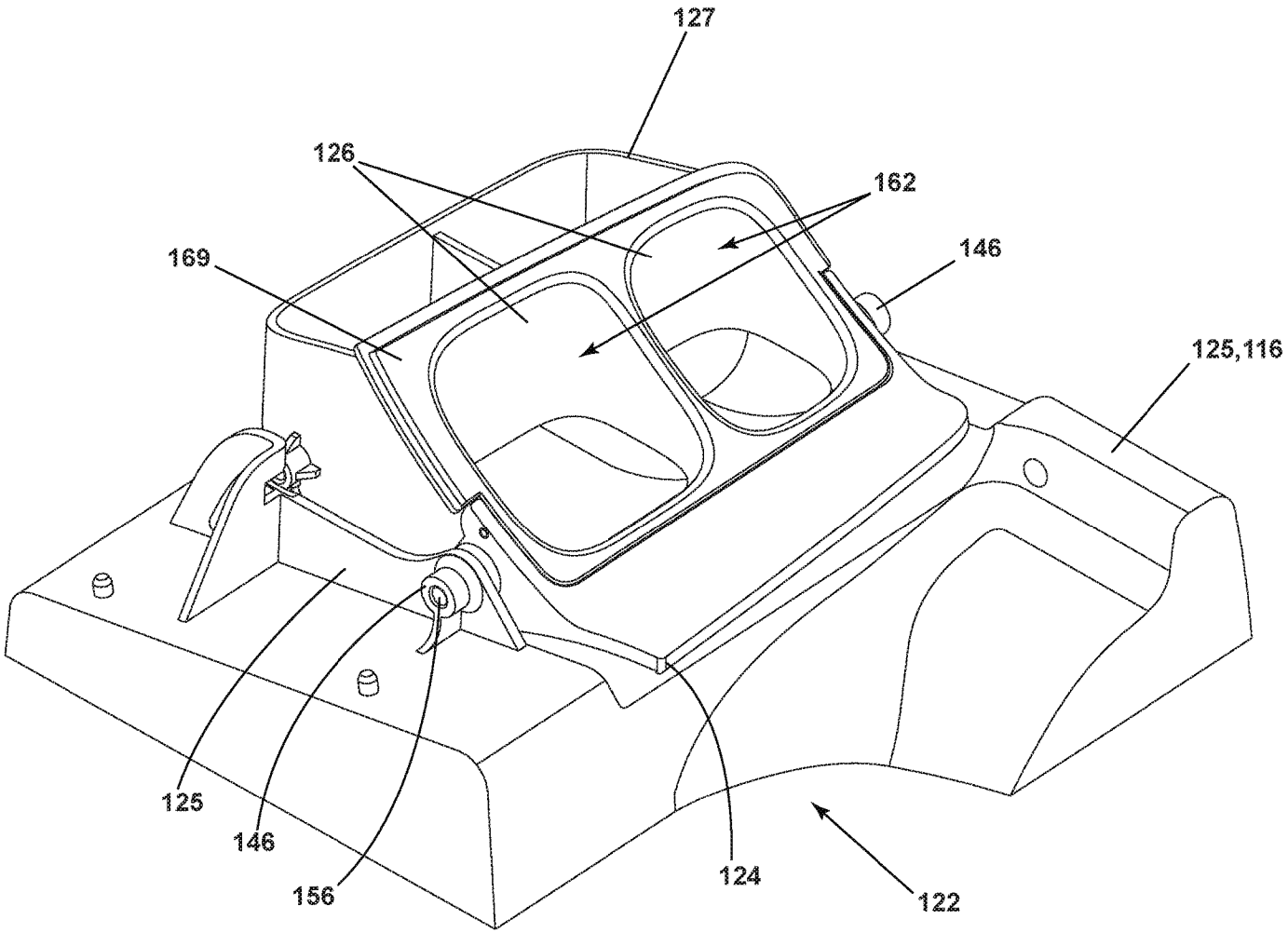
FIG. 6 is a perspective view of a dispenser of the laundry treating appliance of FIG. 5 in an opened position.

Referring to FIG. 6, it can more easily be seen that the dispenser door 124 can carry at least one dispenser container 126. In the illustrated example, fill openings 162 are presented to a user when the dispenser containers 126 are in the extended position. The dispenser door 124 can be pivotally mounted to the dispenser frame 125 through pivot link 156 for pivoting movement between an open position and a closed position overlying the access opening in the shroud (not shown). As shown in the illustration, when the dispenser door 124 is in the opened position, the door 124 can be at least partially received within the frame 125 and can tuck at least partially beneath the dispenser containers 126 (FIG. 8C). Pivot link 156 can comprise a link pivotally connected at each end to door pivots 146, one located on the dispenser frame 125 and the other located on the door 124. An upper edge 169 of the dispenser containers 126 can be an upward facing surface of the dispenser containers 126 and can surround fill openings 162. Upper edge 169 can also be a periphery of the dispenser containers 126 exposed exteriorly when the drawer 127 is in the extended position.

Alternatively, the dispenser containers 126 can be implemented as a drawer 127 having multiple dispenser containers 126. Regardless of the implementation the dispenser containers 126 can be fluidly isolated from each other so that various kinds of treating chemistries can be provided in the different dispenser containers 126 without inter-mixing.

The dispenser drawer 127 is fluidly coupled (not shown) to the treating chamber 114 and slidably mounted to the dispenser frame 125 for sliding movement between extended and retracted positions relative to the frame 125. When the door 124 is in the opened position, the door 124 can be flush with an upward facing surface of the console 172 and can appear as a unitary structure.

Figure 7:
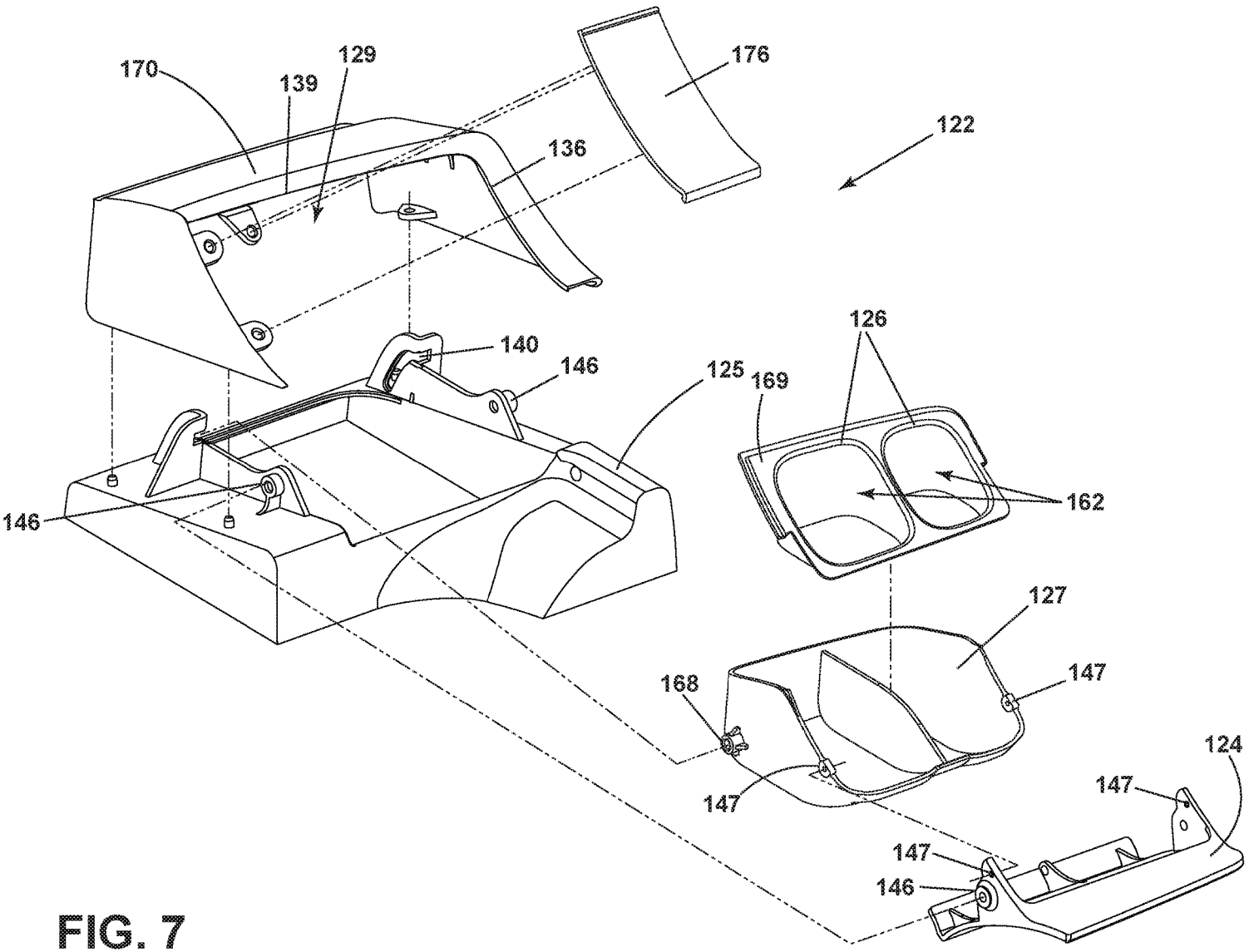
FIG. 7 is an exploded, perspective view of the dispenser of FIG. 6.

FIG. 7 better illustrates the access opening 129 in a shroud 170 covering the frame 125. Shroud panel 176 can be secured to the shroud 170 and can form a continuous front surface with the console and the shroud 170. The upper edge 169 of the dispenser containers 126 can be flush with an upper edge 139 of the access opening 129 when the drawer 127 is in the extended position. Access opening 129 can have a peripheral edge 136 that can include a side edge and the upper edge 139.

A slot 140 in frame 125 can mate with a pin 168 on the drawer 127 to slidably mount the drawer 127 to the dispenser frame 125. The slot 140 can have any shape, but is shown as curvilinear, which results in the drawer 127 raising/lowering as it is moved from the closed/opened positions, respectively. However, the vertical position of the drawer 127 need not change to implement the aspects of the disclosure. Also, the locations of the slot 140 and pin 168 can be reversed. Although only one slot 140 and pin 168 are shown, the slot 140 and pin 168 can be disposed on both sides of the dispenser frame 125.

Continuing with FIG. 7, the drawer 127 can be pivotally mounted to the door 124 by complementary drawer pivots 147 on the door 124 and the drawer 127. Door pivots 146 and drawer pivots 147 provide for a pivoting as well as a raising of the drawer 127 as the door 124 moves from the closed to opened positions, in a motion similar to that provided by the slot 140 and pin 168 structure at a rear portion of the drawer 127. Drawer pivots 147 can be linked by a pivot link 157 (FIG. 8A), and can be an axle or a projection disposed on one of the drawer pivots 147 for mating with its complement. Pivotal movement of the door 124 between the closed and opened position effects a corresponding sliding movement of the drawer 127 between the retracted and extended position, respectively.

A biasing device (not shown) can connect the frame 125 to the door 124 for biasing the dispenser door 124 from the closed to the opened position. A damper (not shown) can comprise a gear track located on the door 124 and a complementary gear rotatably mounted to the dispenser frame 125. The complementary gear meshing with the gear track can provide a smooth opening rate for the door 124 as it moves from the closed to the opened positions in response to the biasing force of the biasing device.

A dual pivoting action can be provided by the door pivots 146 being on a stationary axis and the drawer pivots 147 rotating about the stationary axis of the door pivots 146. The dual pivoting action and slot/pin structure cooperate to raise the drawer 127 and brings it forward as door 124 is at least partially tucked into the dispenser portion of the console 172. The flush cups-to-access-opening and tucked door 124 provides a streamlined finish when the drawer 127 is extended and allows cabinet door 118 to be larger than if the door 124 were not tucked in.

Figure 8A:
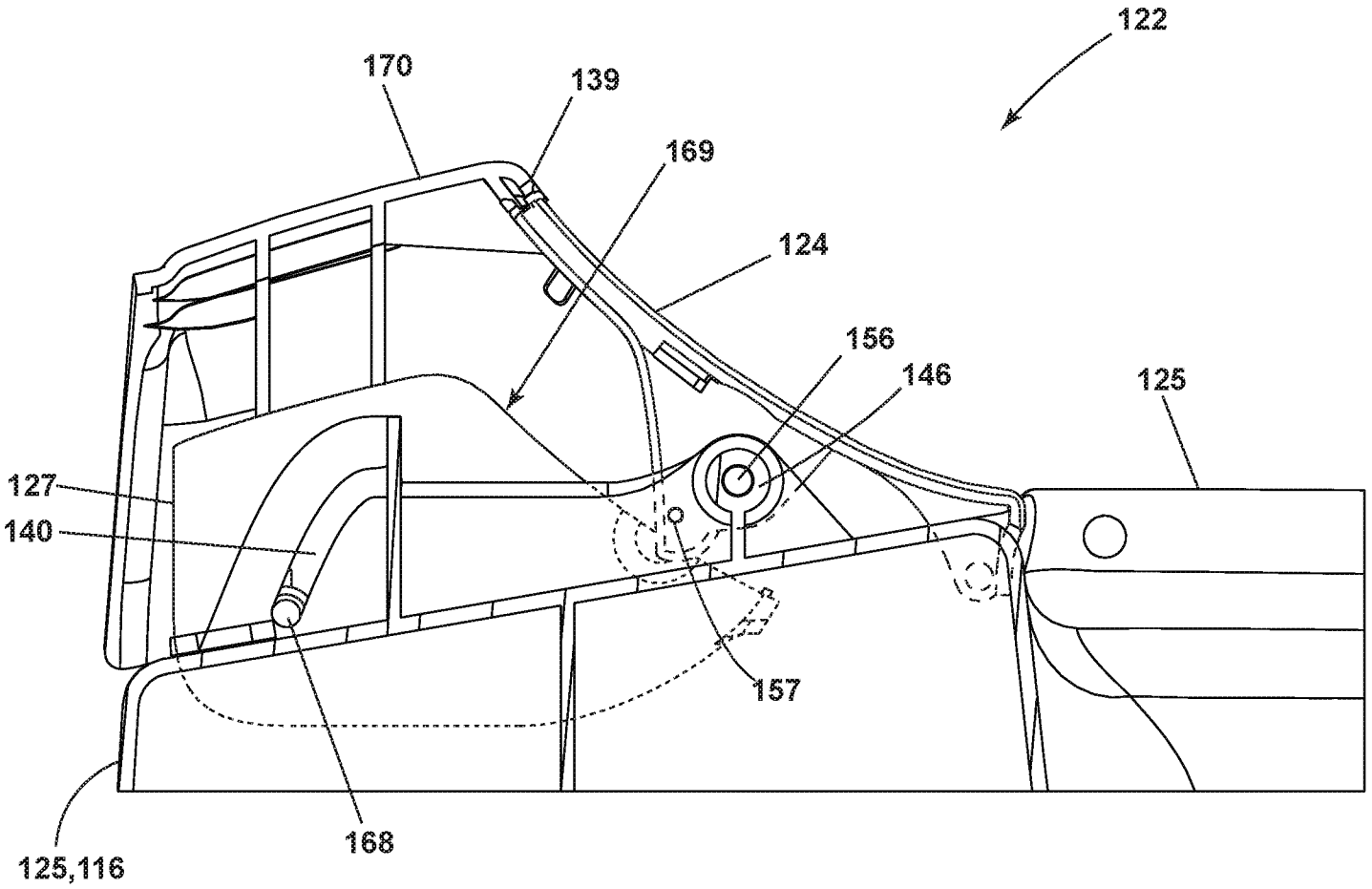
FIG. 8A is a side view of the dispenser in a closed position.

FIG. 8A shows the dispenser 122 with exposed mechanical components in a closed position with door 124 fitting over the access opening in shroud 170. Alternately, the access opening 129 can be in a console extending continuously across a width of the appliance 110. With drawer 127 retracted, pin 168 can be at the bottom of slot 140 and the upper edge 169 of the dispenser containers 126 can be recessed behind upper edge 139 of access opening 129. In the closed position, a biasing device (not shown) can be included and would be fully extended and tensioned. A push-to-open latch (not shown) can be included to secure the dispenser door 124 in the closed position.

Figure 8B:
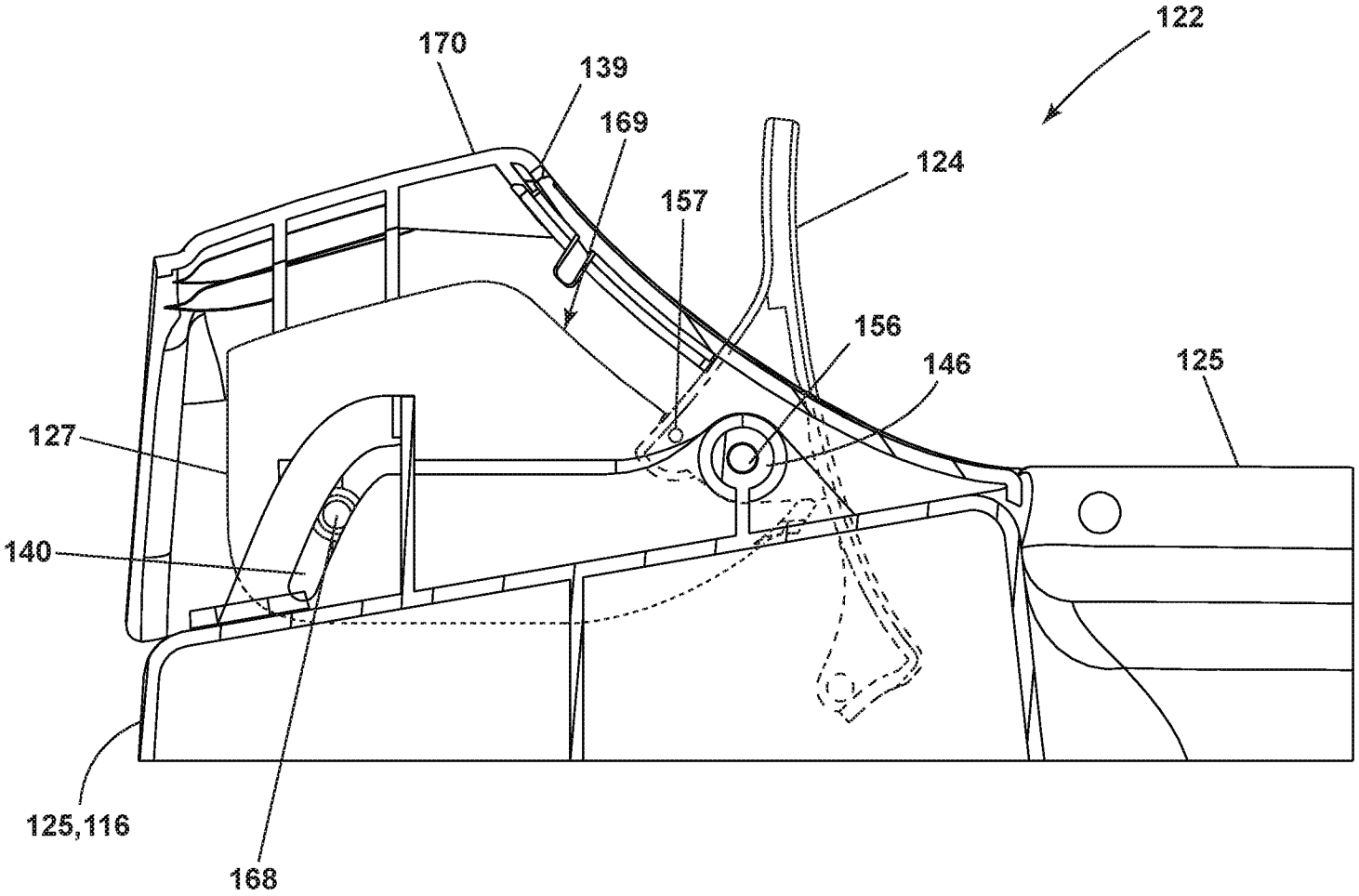
FIG. 8B is a side view of the dispenser in a partially opened position.
Figure 8C:
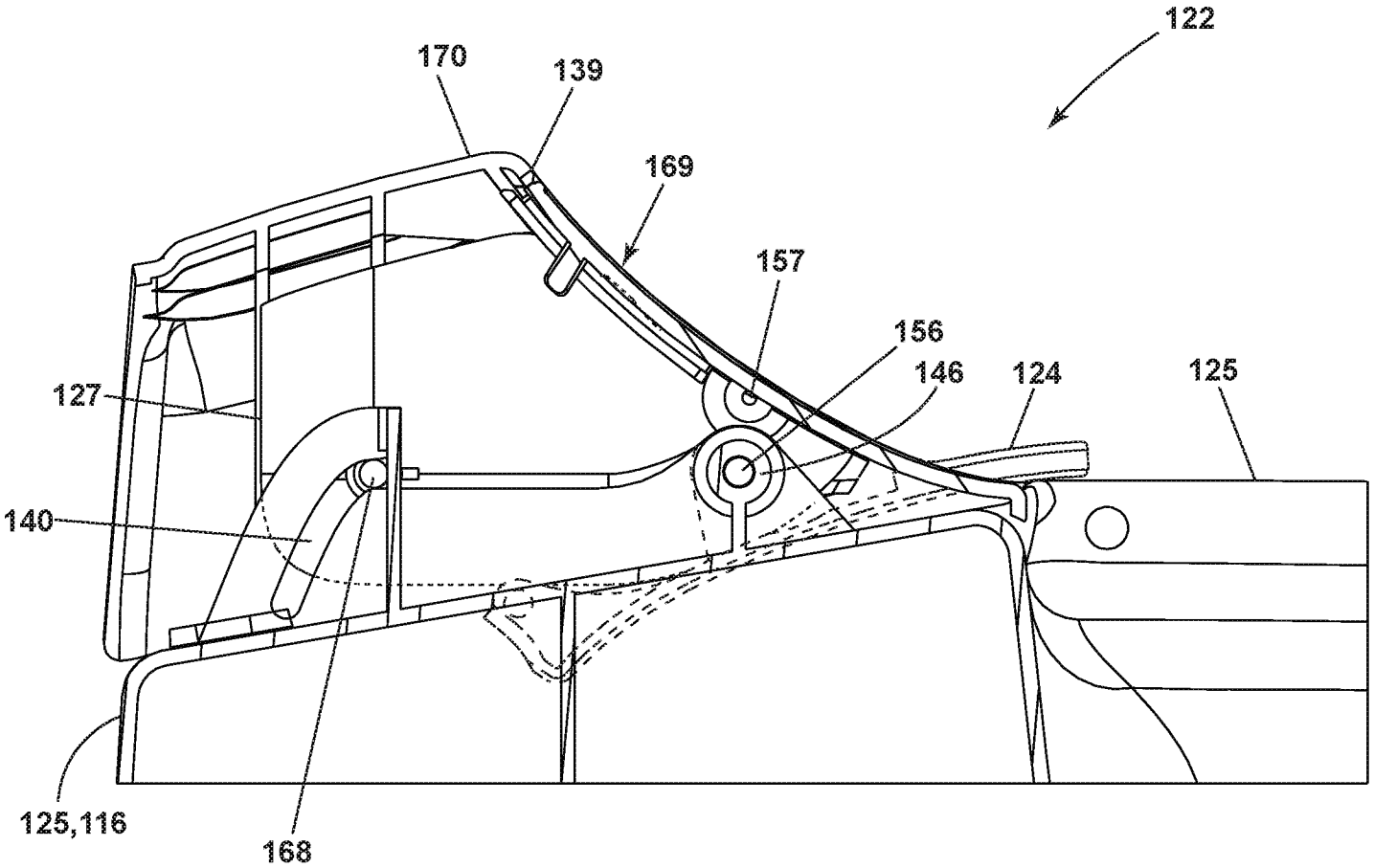
FIG. 8C is a side view of the dispenser in an opened position.

As shown in FIG. 8B, the dispenser is in a partially opened position. When the door is partially opened, the pin 168 can slide along the curvilinear slot 140 as pivot link 157 rotates clockwise around pivot link 156 to pull the drawer 127 upward and forward. A biasing device can be employed to pull the drawer 127 forward. Alternatively, the slot 140 can be configured for forward-only sliding movement of the drawer 127 into the extended position.

Referring to FIG. 8C, when the door 124 is fully opened, the vertical position of the drawer 127 changes along with its sliding position. Dispenser drawer 127 can present itself upward and outward in a single continuous motion such that upper edge 169 of the dispenser containers 126 meet flush with upper edge 139 of the access opening in the shroud 170 or dispenser frame 125. The combination of pivoting and sliding movement of the drawer 127 relative to the dispenser door 124 and dispenser frame 125 can be configured to maintain the drawer 127 at an upright position throughout the opening and closing motion to minimize sloshing of treating chemistry.

Alternatively, the dispenser door 124 and pivots 156 and 157 can be configured such that when the door 124 is in the opened position, the door 124 can be positioned at least partially above the dispenser containers 126 in the extended position. In an above-cup arrangement of open door 124, door 124 is tucked over or within frame 125 such that fill openings 162 are easily accessible for inserting treating chemistry.

The single continuous motion of the dispenser drawer 127 in presenting itself upward and outward creates a pleasant experience for the user. Furthermore, the dispenser containers 126 in the extended position being flush with the access opening 129 and the door 124 matching the profile of the console in the closed position provides an appearance that is clean and aesthetically pleasing to the consumers.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Combinations or permutations of features described herein are covered by this disclosure.

Although illustrative embodiments of the present invention have been shown and described, it would be appreciated by those skilled in the art that changes may be made in these illustrative embodiments without departing from the principles and spirit of the invention, the scope of which is defined in the claims and their equivalents.

The invention claimed is:

1. A laundry treating appliance comprising:

a housing defining an interior that terminates in an upper edge that defines a door profile;

a treating chamber located within the interior and mounted to the housing;

a dispenser door pivotally mounted to the housing for pivoting movement between closed and opened positions;

at least one dispenser cup fluidly coupled to the treating chamber and slidably mounted to the housing for sliding movement between extended and retracted positions; the at least one dispenser cup operably coupled to the dispenser door such that pivotal movement of the dispenser door between the closed and opened positions effects a corresponding sliding movement of the at least one dispenser cup between the retracted and extended positions while maintaining the at least one dispenser cup in an upright position; and wherein the at least one dispenser cup has a portion that is complementary in shape to the door profile and nests within the door profile when the dispenser door is in the opened position and the at least one dispenser cup is in the extended position.

2. The laundry treating appliance of claim 1 wherein the at least one dispenser cup is accessible exterior of the housing in the extended position and located within the housing in the retracted position.

3. The laundry treating appliance of claim 1 wherein the at least one dispenser cup comprises a drawer having multiple cups.

4. The laundry treating appliance of claim 3 wherein the drawer is slidably mounted to the housing.

5. The laundry treating appliance of claim 3 wherein the drawer is pivotally mounted to the dispenser door and pin-and-slot mounted to the housing.

6. The laundry treating appliance of claim 1 further comprising a biasing device that biases the dispenser door from the closed to the opened position.

7. The laundry treating appliance of claim 6 wherein the biasing device comprises a spring extending between the dispenser door and the housing.

8. The laundry treating appliance of claim 1 further comprising a push-to-open latch securing the dispenser door in the closed position.

9. The laundry treating appliance of claim 1 further comprising a damper mounted to the dispenser door and dampening the movement of the dispenser door between the opened and closed positions.

10. The laundry treating appliance of claim 9 wherein one of the at least one dispenser cup and housing has a slot and the other of the at least one dispenser cup and housing has a pin extending in the slot, with the pin being slidable within the slot to slidably mount the at least one dispenser cup to the housing.

11. The laundry treating appliance of claim 10 wherein the slot is curvilinear and the at least one dispenser cup raises/lowers as the at least one dispenser cup extends/retracts, respectively.

12. The laundry treating appliance of claim 1 wherein one of the at least one dispenser cup and housing has a slot and the other of the at least one dispenser cup and housing has a pin extending in the slot, with the pin being slidable within the slot to slidably mount the at least one dispenser cup to the housing.

13. A dispenser assembly for a laundry treating appliance comprising:

a frame that terminates in an upper edge that defines a door profile;

a dispenser door pivotally mounted to the frame for pivoting movement between closed and opened positions;

at least one dispenser cup slidably mounted to the frame for sliding movement between extended and retracted positions; the at least one dispenser cup operably coupled to the dispenser door such that pivotal movement of the dispenser door between the closed and opened positions effects a corresponding sliding movement of the at least one dispenser cup between the retracted and extended positions while maintaining the at least one dispenser cup in an upright position; and wherein the at least one dispenser cup has a portion that is complementary in shape to the door profile and nests within the door profile when the dispenser door is in the opened position and the at least one dispenser cup is in the extended position.

14. The dispenser assembly of claim 13 wherein one of the at least one dispenser cup and frame has a slot and the other of the at least one dispenser cup and frame has a pin extending in the slot, with the pin being slidable within the slot to slidably mount the at least one dispenser cup to the frame.

15. The dispenser assembly of claim 14 wherein the slot is curvilinear and the at least one dispenser cup raises/lowers as the at least one dispenser cup extends/retracts, respectively.

16. The dispenser assembly of claim 13 further comprising a spring extending between the door and the frame and biasing the dispenser door to the opened position.

17. The dispenser assembly of claim 13 further comprising a push-to-open latch securing the dispenser door in the closed position.

18. The dispenser assembly of claim 17 further comprising a damper mounted to the dispenser door and dampening the movement of the dispenser door between the opened and closed positions.

19. The dispenser assembly of claim 13 wherein the at least one dispenser cup is slidably mounted to the frame for sliding movement between the extended and retracted positions.

20. The dispenser assembly of claim 13 wherein the dispenser door is pivotally mounted to the frame for pivoting movement between the closed and opened positions.

* * * * *